US005409191A

United States Patent [19]

Wenmaekers

[11] Patent Number: 5,409,191

[45] Date of Patent: Apr. 25, 1995

[54] SIGN SUPPORT FOR ENGAGING A SUSPENDED CEILING

[75] Inventor: Marie J. Wenmaekers, Winnipeg, Canada

[73] Assignee: Jules Duclos, Winnipeg, Canada

[21] Appl. No.: 119,489

[22] Filed: Sep. 13, 1993

[51] Int. Cl.[6] ..... A47H 1/10

[52] U.S. Cl. ..... 248/317; 40/617

[58] Field of Search ..... 248/323, 327, 317; 40/617; 52/38, 39

[56] References Cited

U.S. PATENT DOCUMENTS

| | | | |
|---|---|---|---|
| 2,074,660 | 3/1937 | Masoner . | |
| 2,650,056 | 8/1953 | Masoner . | |
| 3,154,870 | 11/1964 | Hopp | 40/617 X |
| 3,181,274 | 5/1965 | Izenour . | |
| 3,604,672 | 9/1971 | Askesjo . | |
| 3,719,818 | 3/1973 | Porter | 248/317 |
| 3,883,972 | 5/1972 | Propst et al. . | |
| 4,068,817 | 1/1978 | Berger | 248/327 |
| 4,089,129 | 5/1978 | Patterson | 248/317 X |
| 4,135,692 | 1/1979 | Ferguson | 248/317 X |
| 4,229,913 | 10/1980 | Corrigan . | |
| 4,412,478 | 11/1983 | Osher et al. . | |
| 4,564,165 | 1/1986 | Grant et al. . | |
| 4,646,997 | 3/1987 | Fadley . | |

FOREIGN PATENT DOCUMENTS

| | | | |
|---|---|---|---|
| 2351464 | 5/1976 | France | 40/617 |
| 2233808 | 1/1991 | United Kingdom | 40/617 |

*Primary Examiner*—J. Franklin Foss

*Attorney, Agent, or Firm*—Adrian D. Battison; Stanley G. Ade; Murray E. Thrift

[57] ABSTRACT

An apparatus for hanging a sign from a suspended ceiling of the type including T-runners and intervening ceiling panels comprises a ceiling engaging member defined by an extruded bar having a pair of tabs attached to each end so as to extend outwardly in the horizontal top plane of the bar. The bar includes a vertically extending slot for receiving the blade of a handle by which the bar can be lifted and twisted to engage the tabs on top of the T-runners of the ceiling. A central raised button allows the bar to be rotated against the ceiling panel. A second extruded bar is attached to the first by a central coupling head which allows the second bar to rotate. The sign is attached to the second bar and suspended therefrom, the vertical plane of the sign being movable between different orientations by rotation of the second bar.

24 Claims, 4 Drawing Sheets

SIGN SUPPORT FOR ENGAGING A SUSPENDED CEILING

BACKGROUND OF THE INVENTION

This invention relates to an apparatus for hanging a sign from a ceiling.

In stores and similar situations where display signs are required, it is often desirable to suspend a sign from the ceiling so that it can depend downwardly toward the passersby in a particular area of the building within which the sign is located. Many buildings are clad with a suspended ceiling in the form of a plurality of parallel longitudinal support bars each of which defines a horizontal flange along each side onto which an edge of an acoustic ceiling panel is placed with the panel spanning the space between one bar and the next adjacent bar.

It is highly desirable, therefore, to be able to provide an arrangement which attaches to the suspended ceiling and can support a suspended sign or banner at any required location across the ceiling.

One example of an arrangement of this type is shown in U.S. Pat. No. 4,564,165 [Grant] and this comprises a clip member which engages over the conventional T-runner of the ceiling at the flange of the T. The clip then receives a sign engaging and supporting member which snaps around the clip. This arrangement is disadvantageous in that it is limited to a particular orientation that is longitudinally of the T-runners and in addition the attachment of the elements to the ceiling is relatively difficult and requires generally a person to climb up to a position at the ceiling. This is undesirable both from the point of view of the necessity for stepladders and the like and from the point of view of the danger of climbing.

Another example is shown in U.S. Pat. No. 3,883,972 [Propst] which discloses a similar form of clip with a channel at one end for engaging onto a support. However again the clip is of a type which requires the installer to climb to the height of the support and again there is little ability for adjustment.

U.S. Pat. No. 3,604,672 [Askesjo] discloses a teaching aid which is suspended from the ceiling. This comprises a frame arrangement which is firstly attached to the ceiling and on this is carried a bracket which supports a roll map, screen or the like. This arrangement is not intended for nor suitable for attachment to the T-bars of a suspended ceiling.

U.S. Pat. No. 3,181,274 [Izenour] discloses a special form of ceiling arrangement defining tracks which can receive a horizontal head of a vertical support stud attached to a sign. This system requires a special form of suspended ceiling and thus is unsuitable for already existing conventional types of ceilings.

Other patents that have been identified in this field are U.S. Pat. Nos. 4,412,478 [Osher], 4,229,913 [Corrigan], 4,646,997 [Fadley], 2,650,056 [Masoner] and 2,074,660 [Masoner]. None of these is relevant to the support of a sign on a conventional suspended ceiling arrangement.

It is one object of the present invention, therefore, to provide an improved support apparatus for hanging a sign from a suspended ceiling in which the sign and the apparatus can be attached to the ceiling from ground level without the necessity for climbing.

It is a further object of the present invention to provide an apparatus of this type which is readily attached to a suspended ceiling without difficulty and without damaging the ceiling itself.

It is yet a further object of the present invention to provide an apparatus of this general type in which the orientation of the sign can be adjusted regardless of the orientation of the ceiling structure.

SUMMARY OF THE INVENTION

According to a first aspect of the invention there is provided apparatus for hanging a sign from a ceiling comprising a ceiling engaging member for engaging a ceiling so as to be supported thereby, sign support means arranged for receiving and supporting a hanging sign depending therefrom, means interconnecting the ceiling engaging member and the sign support means, and a handle member for effecting attachment of the ceiling engaging member to the ceiling, the handle member comprising an elongate manually maneuverable handle and an operating member on an end of the handle, the operating member and ceiling engaging member being cooperatively shaped so as to provide support of the ceiling engaging member on the handle member, so as to communicate upward force from the handle member to the ceiling engaging member and so as to communicate rotation of the handle member about a longitudinal axis of the handle member to the ceiling engaging member.

According to a second aspect of the invention there is provided apparatus for hanging a sign from a ceiling comprising a ceiling engaging member for engaging a ceiling so as to be supported thereby, sign support means arranged for receiving and supporting a hanging sign depending therefrom, and means interconnecting the ceiling engaging member and the sign support means, wherein the ceiling engaging member comprises an elongate bar and a pair of tab members each extending longitudinally outwardly from a respective end of the bar substantially at a horizontal upper surface of the bar.

According to a third aspect of the invention there is provided apparatus for hanging a sign from a ceiling comprising a ceiling engaging member for releasably engaging a T-bar support of a suspended ceiling so as to be supported thereby, sign support means arranged for receiving and supporting a hanging sign depending therefrom, and means interconnecting the ceiling engaging member and the sign support means, wherein said interconnecting means is arranged to connect the ceiling engaging member to the sign support means at a midpoint therealong for rotational movement of the sign support means relative to the ceiling engaging member about a vertical axis extending therethrough, One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
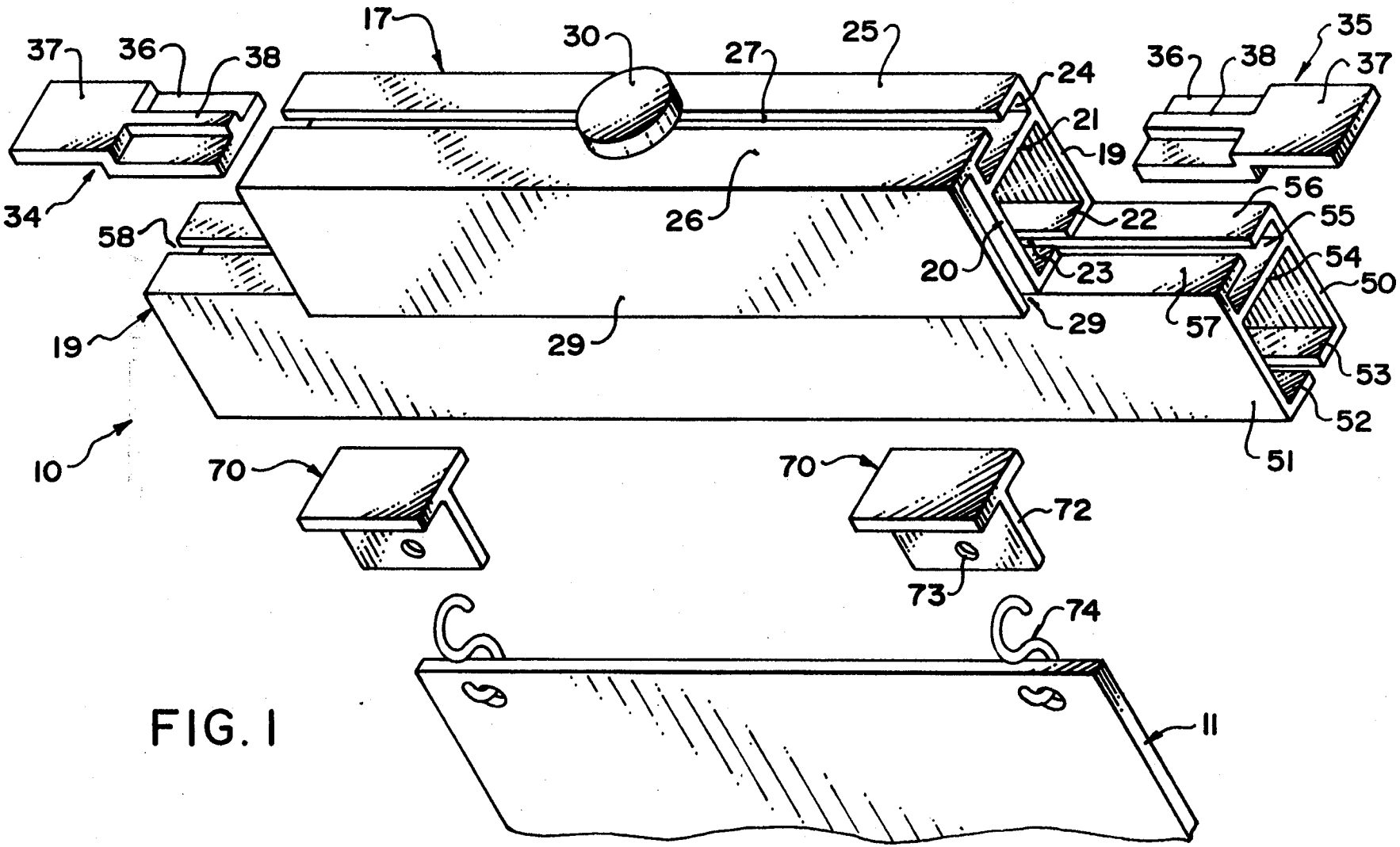
FIG. 1 is an isometric exploded view of one embodiment of apparatus for hanging signs.

The apparatus for suspending a hanging sign is generally indicated at 10 for supporting a sign 11 from a ceiling 12, The ceiling is of the type comprising a plurality of spaced parallel support bars 13 between which are suspended horizontal ceiling panels 14. Each of the support bars 13 is of inverted T-shape often known as a T-runner thus defining horizontal flanges 15 and 16 on which the panels 14 sit.

The apparatus 10 comprises a ceiling engaging member 17 and a sign supporting member 18.

Figure 3:
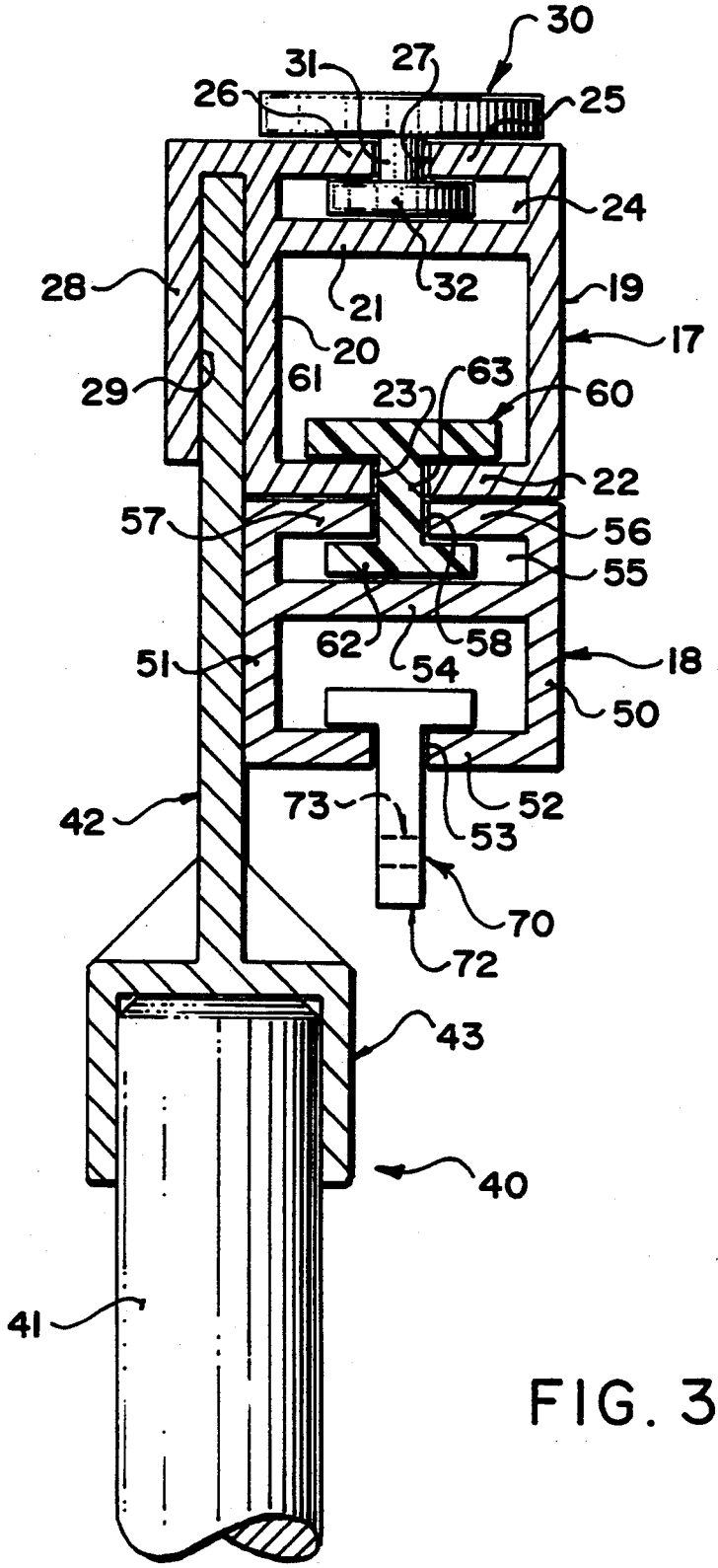
FIG. 3 is a cross-sectional view along the lines 3—3 of FIG. 2 on an enlarged scale.

The ceiling engaging member 17 comprises an elongate bar formed from a portion of an extruded profile, the cross-section of which is best shown in FIG. 3. The cross-section thus comprises a first rectangular section defined by a first side wall 19, a second parallel side wall 20, a top wall 21 and a bottom wall 22. The bottom wall 22 has a central vertical slot 23. Above the top wall 21 is defined a horizontal slot 24 formed by flanges 25 and 26 parallel to the top wall 21 and spaced upwardly therefrom. The flanges 25 and 26 are separated to define a vertical slot 27 therebetween. On an outer side of the side wall 20 is provided a vertical flange 28 which defines between the vertical flange and the side wall 20 a vertical slot 29 facing downwardly of the profile.

The ceiling engaging member further comprises a central raised button 30 which is arranged centrally of the bar and comprises a disk shaped top portion, a neck 31 extending through the vertical slot 27 and a bottom retainer 32 slideable within the horizontal slot 24. Thus the raised button 30 can be inserted longitudinally of the slot 27 and moved along the bar to approximately the center position at which is remains by frictional engagement with the bar.

Figure 2:
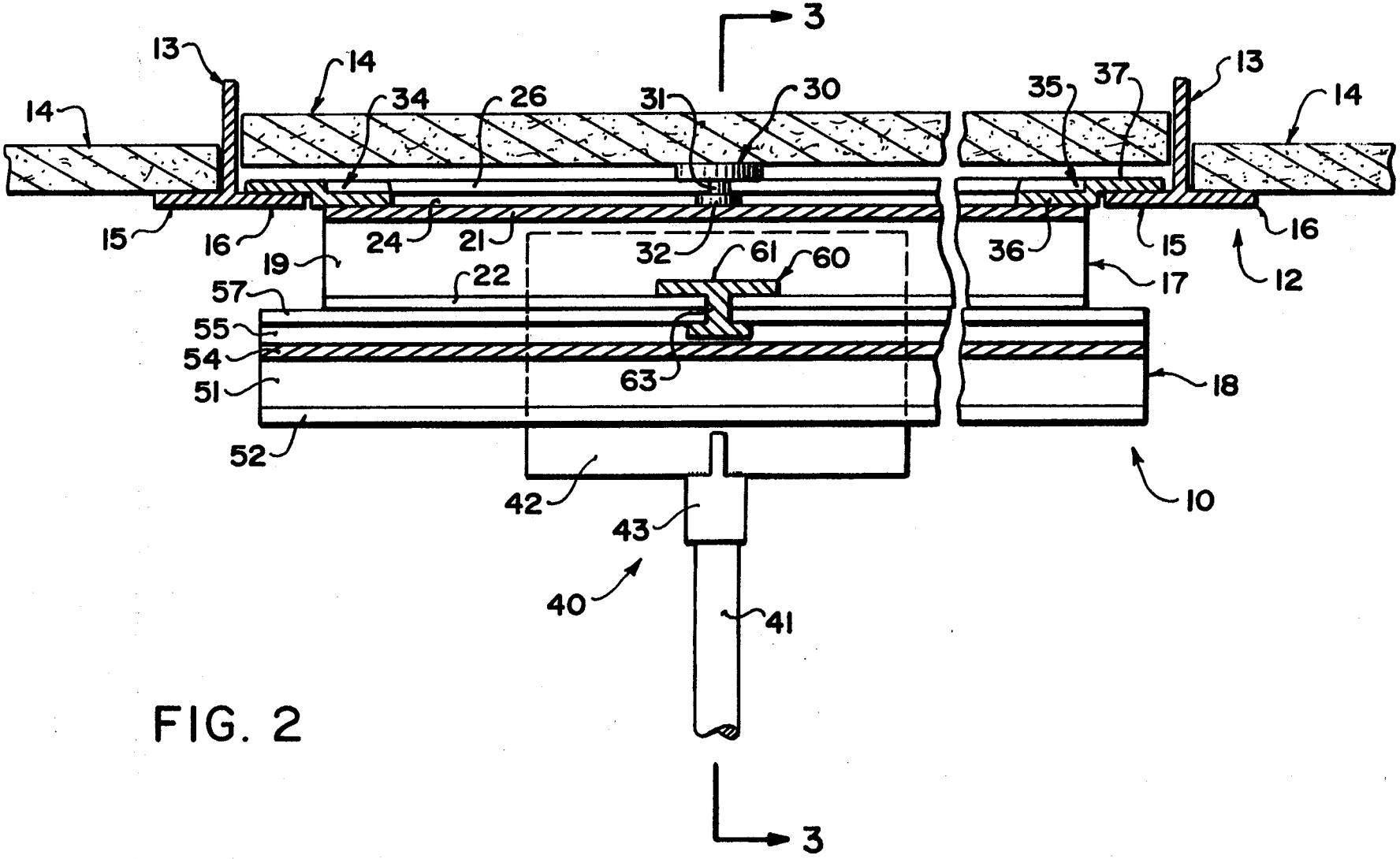
FIG. 2 is a vertical longitudinal cross-sectional view through the apparatus of FIG. 1.

The ceiling engaging member further comprises a pair of tab members 34 and 35. Each of these includes an insert 36 and a horizontal tab plate 37. The insert 36 basically comprises a flat plate which slides into the end of the horizontal slot 24. The insert further includes a raised rib 38 along the top surface thereof for engaging into the vertical slot 27 thus maintaining the insert in fixed position in the end of the slots 24 and 27 by frictional engagement therewith. The tab plate 37 is stepped relative to the main plane of the insert so that the tab plate, as best shown in FIG. 2, lies in the plane of the top surface of the bar defined by the flanges 25 and 26. The width of the tab plate 37 is substantially equal to the width of the bar. The bar is thus generally rectangular in cross-section and the tab plates form simply horizontal elements at the top of the bar.

The apparatus further includes a handle member for moving the ceiling engaging member into position in engagement with the ceiling and for releasing the ceiling engagement member from its engaged position. The handle member comprises an elongate handle 41 which can be manually manipulated and maneuvered from a person standing on the floor thus spaced from the ceiling. The handle member further includes a blade portion 42 which is generally transverse to the handle 41 and attached to the handle by a sleeve 43. The blade has a width significantly greater than the handle so the rotation of the handle causes the blade to rotate about the longitudinal axis of the handle. As shown in FIGS. 2 and 3, the blade is inserted into the slot 29 so that upward force on the handle 41 pushes the blade upwardly and thus pushes the ceiling engaging member upwardly. Also rotation of the handle about its longitudinal axis causes the ceiling member to be rotated similarly about the axis.

The ceiling member can thus be inserted into the position shown in FIG. 2 in which it is engaged with the T-runners by moving the bar up to the ceiling, rotating the bar slightly so that the bar is arranged at an angle different from 90 degrees to the T-runners and the tabs 37 are arranged just inside the T-bars and then by pushing the bar upwardly to slightly lift the respective ceiling panel 14 away from the T-runners. The bar is then rotated to a position at right angles to the T-runners so that the tabs 37 engage over the top surfaces of the flanges of the T-runners to sit in place on those flanges and to be carried thereby. The central raised button 30 engages the underside of the panel and assists it in allowing rotation of the bar relative to the panel, particularly bearing in mind that some of the panels include a roughened surface for attractive appearance. Thus from ground level using the handle and the blade, the ceiling engaging member can be lifted, pushed and slightly twisted into the engagement position shown in FIG. 2. It can of course be removed simply by reversing the process.

The sign support member 18 comprises a similar bar formed from an extruded profile, the cross-section of which is shown in FIG. 3. The cross-section of the profile 18 includes again a basic rectangular section defined by a side wall 50, a second parallel side wall 51, a bottom wall 52 with a vertical slot 53, and a top wall 54. Above the top wall 54 is defined a horizontal slot 55 formed by flanges 56 and 57 similar to the flanges 25 and 26. Between the flanges 56 and 57 is provided a vertical slot 58.

The bar 17 is attached to the bar 18 by a central coupling element 16 including a rectangular head 61 slideable along the top surface of the bottom wall 22 and a circular head 62 slideable along the undersurface of the flanges 56 and 57, the heads 61 and 62 being connected by a neck 63 passing through the slots 23 and 58. The coupling member 60 is engaged as a friction fit with the bar 17 and 18 generally thus holding them in parallel position as shown in the Figures. However it will be appreciated that the bar 18 can be rotated about the axis of the neck 63 simply by pivotal movement of the bar 18 on the neck 63. This allows the sign support bar 18 to take up a position parallel to bar 17, at right angles to the bar 17 or at any position intermediate.

As shown in FIG. 3, the width of the bar 18 is equal to the width of bar 19 excluding the flange 28 so that the blade 42 can pass alongside the bar 18 into the slot 29.

The sign 11 can be attached directly to the bar 18 simply by sliding a bead at the top of the sign into the slot 53.

In an alternative mounting arrangement shown in FIG. 1, there is provided pair of T-shaped support elements 70 and 71 each of which includes a vertical plate slideable along the slot 53 and a horizontal crossbar which sits on the top surface of the bottom wall 52. The vertical plate 72 includes a hole 73 for receiving an S-hook 74 at a top of the sign 11.

Figure 4:
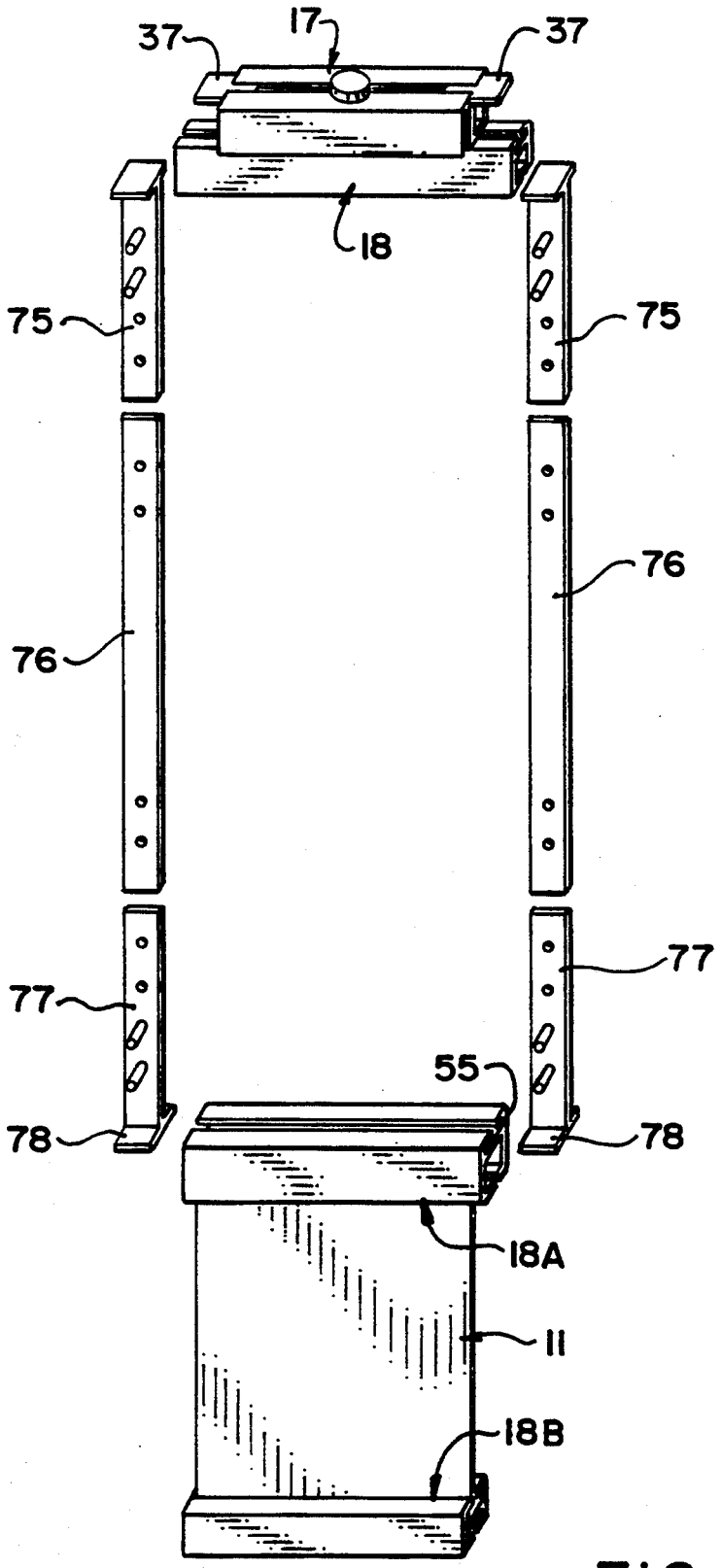
FIG. 4 is an exploded view of the apparatus of FIG. 1 incorporating an extension system for suspending the sign at a lower position.

As shown in FIG. 4, a modified arrangement of the support elements 70 and 71 is shown in which the vertical support plate 75, 76 is elongated by providing additional straps 77 and 78 and bottom coupling elements 79 and 80. This allows the length of the vertical bars to be adjusted so as to lower the top edge of the sign 11 to a required height when the ceiling is particularly high. In the arrangement shown in FIG. 4, a further portion of the profile of the sign engaging bar indicated at 18A and 18B is attached to the top and bottom of the sign 11 by a bead along the top and bottom edge of the sign 11. The slot 24 of the bar 18A is then used to receive the bottom transverse bars 81 and 82 of the coupling elements 79 and 80.

The sign support system of the present invention can thus be used simply from ground level to be engaged with the ceiling and to be removed allowing the sign to be replaced, cleaned or the like. The orientation of the sign can be adjusted as required independently of the direction of the T-runners of the ceiling. The apparatus is manufactured inexpensively and simply from portions of extruded profile and a number of minor injection molded elements providing the tabs, couplings and the raised button.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for hanging a sign from a ceiling having a plurality of parallel panel support runners with each adjacent pair of runners spaced to define a space therebetween and a plurality of panels bridging the space between the support runners and supported thereby, the apparatus comprising a ceiling engaging member for engaging the ceiling so as to be supported thereby, the ceiling engaging member comprising an elongate member for bridging the space between said adjacent pair of support runners and a pair of tab members each extending longitudinally outwardly from a respective end of the elongate member for engaging onto a respective one of said adjacent pair of runners for support thereby, sign support means arranged for receiving and supporting a hanging sign depending therefrom, means interconnecting the ceiling engaging member and the sign support means, and a handle member for effecting attachment of the ceiling engaging member to the ceiling, the handle member comprising an elongate manually maneuverable handle and an operating member on an end of the handle, the operating member and ceiling engaging member being cooperatively shaped so as to provide support of the ceiling engaging member on the handle member, so as to communicate upward force from the handle member to the ceiling engaging member and so as to communicate rotation of the handle member about a longitudinal axis of the handle member to the ceiling engaging member.

2. The apparatus according to claim 1 wherein the operating member comprises a blade extending generally transversely to the longitudinal axis of the handle member and wherein the ceiling engaging member includes means defining a substantially vertical slot therein for receiving the blade.

3. The apparatus according to claim 1 including rotation means for extending upwardly above the elongate member into engagement with a panel when the operating member is lifting the ceiling engaging member for allowing rotation of the ceiling engaging member relative to the panel.

4. The apparatus according to claim 3 wherein the rotation means comprises a raised member on the elongate member on an upper surface thereof at a position part way therealong.

5. The apparatus according to claim 1 wherein the elongate member comprises a portion of an extruded profile and wherein each of the tab members is separate from the portion and includes a horizontal tab plate and an insert engageable as a friction fit into an end of the portion.

6. The apparatus according to claim 5 wherein the profile includes a horizontal slot substantially at the top surface of the portion and wherein the insert slides into the horizontal slot.

7. The apparatus according to claim 5 wherein the tab plate is vertically offset from the insert.

8. The apparatus according to claim 1 wherein the operating member comprises a blade extending generally transverse to the longitudinal axis of the handle member and wherein the ceiling engaging member includes means defining a substantially vertical slot therein for receiving the blade, the ceiling engaging member comprising a portion of an extruded profile and wherein said means defining the slot comprises a vertical flange defining one side of the profile.

9. The apparatus according to claim 8 wherein the profile comprises a main rectangular portion defined by one side wall, a second side wall adjacent the flange, a top wall and a bottom wall, a vertical slot being formed longitudinally of the bottom wall, and means defining a horizontal slot parallel to the top wall.

10. The apparatus according to claim 1 wherein the sign support means comprises a second elongate member lying in a plane parallel to the elongate member of the ceiling engaging member and wherein said interconnecting means is arranged to connect the ceiling engaging member to the sign support means for rotational movement of the sign support means relative to the ceiling engaging member about an axis extending therethrough at right angles to the plane for rotation of the sign support means in said plane.

11. The apparatus according to claim 10 wherein the sign support means includes means defining a T-shaped slot along an upper surface thereof and wherein the interconnecting means comprises a head portion for engaging in the T-shaped slot and a base portion for engaging the ceiling support member.

12. The apparatus according to claim 1 wherein the sign support means comprises second elongate member defined by a portion of an elongate extruded profile, the profile defining a substantially rectangular cross-section having a top wall, two side walls and a bottom wall, the bottom wall having a longitudinal slot therealong.

13. The apparatus according to claim 12 wherein the sign support means includes a sign support tab having a vertical support plate for extending through the slot and a horizontal flange at the top of the support plate such that the horizontal flange slides on an upper surface of the bottom wall.

14. The apparatus according to claim 13 wherein the vertical support plate of the sign support tab is elongate so as to support the sign at a position spaced vertically downwardly from an underside of the bottom wall.

15. Apparatus for hanging a sign from a ceiling having a plurality of parallel panel support runners with each adjacent pair of runners spaced to define a space therebetween and a plurality of panels bridging the space between the support runners and supported thereby, the apparatus comprising a ceiling engaging member for engaging a ceiling so as to be supported thereby, sign support means arranged for receiving and supporting a hanging sign depending therefrom, and means interconnecting the ceiling engaging member and the sign support means, wherein the ceiling engaging member comprises an elongate member for bridging the space between said adjacent pair of support runners and a pair of tab members each extending longitudinally outwardly from a respective end of the bar for engaging onto a respective one of said adjacent pair of runners for support thereby.

16. The apparatus according to claim 15 wherein the bar comprises a portion of an extruded profile and wherein each of the tab members is separate from the portion and includes a horizontal tab plate and an insert engageable as a friction fit into an end of the portion.

17. The apparatus according to claim 16 wherein the profile includes a horizontal slot substantially at the top surface of the portion and wherein the insert slides into the horizontal slot.

18. The apparatus according to claim 17 wherein the tab plate is vertically offset from the insert.

19. The apparatus according to claim 15 wherein the elongate member includes a raised member on the upper surface thereof at a position part way therealong.

20. Apparatus for hanging a sign comprising a ceiling having a plurality of parallel panel support runner means with each adjacent pair of runner means spaced to define a space therebetween and a plurality of panels bridging the space between the support runner means and supported thereby, a horizontal elongate ceiling engaging bar for releasably engaging said runner means so as to be supported thereby, an elongate sign support bar arranged for receiving and supporting a hanging sign depending therefrom, the ceiling engaging bar and the sign support bar each lying in one of two respective horizontal planes parallel to the ceiling and means interconnecting the ceiling engaging bar and the sign support bar, wherein said interconnecting means is arranged to connect the ceiling engaging bar to the sign support bar substantially at a midpoint the sign support bar for rotational movement of the sign support bar relative to the ceiling engaging bar about a vertical axis extending therethrough for rotation of the sign support bar in said horizontal plane.

21. Apparatus for hanging a sign comprising a ceiling having a plurality of parallel panel support runners with each adjacent pair of runners spaced to define a space therebetween and a plurality of panels bridging the space between the support runners and supported thereby, a ceiling engaging member engaging the ceiling so as to be supported thereby, the ceiling engaging member bridging the space between said adjacent pair of support runners and engaging onto each of said adjacent pair of runners for support thereby, sign support means receiving and supporting a hanging sign depending therefrom, means interconnecting the ceiling engaging member and the sign support means, a handle member for effecting attachment of the ceiling engaging member to the ceiling, the handle member comprising an elongate manually maneuverable handle and an operating member on an end of the handle, the operating member and ceiling engaging member being cooperatively shaped so as to provide support of the ceiling engaging member on the handle member, so as to communicate upward force from the handle member to the ceiling engaging member and so as to communicate rotation of the handle member about a longitudinal axis of the handle member to the ceiling engaging member and swivel means for engaging a panel between the runners to allow rotation of the ceiling engaging member relative to the panel about a vertical axis for engagement of the ceiling engaging onto and release from said adjacent pair of support runners.

22. The apparatus according to claim 21 wherein the operating member comprises a blade extending generally transversely to the longitudinal axis of the handle member and wherein the ceiling engaging member includes means defining a substantially vertical slot therein for receiving the blade.

23. The apparatus according to claim 21 wherein the swivel means comprises a raised member on the ceiling engaging member on an upper surface thereof at a position part way therealong.

24. The apparatus according to claim 21 wherein the sign support means comprises an elongate member lying in a plane parallel to the ceiling engaging member and wherein said interconnecting means is arranged to connect the ceiling engaging member to the sign support means for rotational movement of the sign support means relative to the ceiling engaging member about an axis extending therethrough at right angles to the plane for rotation of the sign support means in said plane.

* * * * *